United States Patent [19]

Pond et al.

[11] Patent Number: 5,075,655

[45] Date of Patent: Dec. 24, 1991

[54] ULTRA-LOW-LOSS STRIP-TYPE TRANSMISSION LINES, FORMED OF BONDED SUBSTRATE LAYERS

[75] Inventors: Jeffrey M. Pond, Alexandria, Va.; Irving Kaufman, Tempe, Ariz.; Henry F. Gray, Alexandria, Va.

[73] Assignee: The United States of America as represented by the Secretary of the Navy, Washington, D.C.

[21] Appl. No.: 444,253

[22] Filed: Dec. 1, 1989

[51] Int. Cl.[5] ..... H01P 3/08

[52] U.S. Cl. ..... 333/238; 333/99 S; 505/866

[58] Field of Search ..... 333/99 S, 161, 204, 333/238, 246; 505/866, 701, 703, 704

[56] References Cited

U.S. PATENT DOCUMENTS

| | | | |
|---|---|---|---|
| 3,142,808 | 7/1964 | Gonda | 333/204 |
| 3,225,351 | 12/1965 | Chatelain et al. | 333/238 X |
| 4,379,307 | 4/1983 | Soclof | 333/238 X |
| 4,785,271 | 11/1988 | Higgins, Jr. | 333/204 |

FOREIGN PATENT DOCUMENTS

| | | | |
|---|---|---|---|
| 50702 | 4/1980 | Japan | 333/238 |
| 248005 | 12/1985 | Japan | 333/246 |
| 190404 | 8/1988 | Japan | 333/246 |
| 106602 | 4/1989 | Japan | 333/116 |
| 125101 | 5/1989 | Japan | 333/227 |

OTHER PUBLICATIONS

Wallis, G. and Pomerantz, D.; "Field Assisted Glass-Metal Sealing"; *Journal of Applied Physics;* vol. 40, No. 10; pp. 3946–3949; Sep. 1969.

*Primary Examiner*—Eugene R. LaRoche
*Assistant Examiner*—Benny T. Lee
*Attorney, Agent, or Firm*—Thomas E. McDonnell; Charles J. Stockstill

[57] ABSTRACT

A method of constructing ultra-low-loss miniaturized microstrip type microwave transmission lines, circuits, and resonators and their resulting structures are disclosed. The method includes etching a groove of the appropriate width and depth into the surface of a first substrate as determined by a preselected characteristic impedance. Appropriate thin film superconductors are then deposited on the surfaces of the first substrate and a second substrate. The thin film superconductors are then patterned after which the two substrates are sealed together by field-assisted thermal bonding such that a novel two-conductor electromagnetic transmission line results.

14 Claims, 2 Drawing Sheets

SUBSTRATE 1

SUBSTRATE 2

SUBSTRATE 1

SUBSTRATE 2

ULTRA-LOW-LOSS STRIP-TYPE TRANSMISSION LINES, FORMED OF BONDED SUBSTRATE LAYERS

FIELD OF THE INVENTION

This invention relates to techniques of constructing ultra-low-loss miniaturized microstrip type microwave transmission lines, circuits, and resonators having low dielectric loss and the resulting structures.

BACKGROUND DESCRIPTION

Losses in a microwave transmission line establish a limit on the maximum distance that a signal will be allowed to propagate before it has been attenuated to the point of existing with undesirably low signal-to-noise ratio. Losses in a resonator or filter circuit limit the frequency discrimination that can be effected with such components. It is therefore generally desirable to construct microwave circuits that have a minimum amount of loss.

The sources of loss in a microwave structure are radiation loss, conductor loss, and dielectric loss. Radiation loss may be minimized by shielding of a circuit, i.e., putting it in a closed metal container. Conductor losses can often be minimized by using superconducting materials which are operated appreciably below their critical temperature, $T_c$. Dielectric loss, which is due to the imperfect behavior of bound charges, exists whenever dielectric materials are located in a time varying electric field.

Recently, strip-type microwave superconducting transmission lines that utilize the "kinetic inductance" of superconductors have been fabricated. It has been demonstrated that these lines can propagate microwave energy at speeds on the order of 0.01 c, where c is the speed of light in free space. See "Measurements and Modeling of Kinetic Inductance Microstrip Delay Lines", *IEEE Trans. on Microwave Theory and Tech.*, MTT-35, no. 12, pp. 1256–1262, December 1987, by J. M. Pond, J. H. Claassen, and W. L. Carter. The basic structure of these lines is shown in FIG. 1. As indicated in FIG. 1, such lines were fabricated by depositing a "ground plane" 12 of very thin superconducting material on an appropriate substrate for thermal bonding techniques. This deposition was followed by a very thin dielectric layer 14. Another very thin superconducting film 16 was deposited on top of this structure and patterned, so as to produce the microstrip structure as shown in FIG. 1.

Such a superconducting transmission line has a propagation velocity, $V_p$, given by:

$$v_p=(LC)^{-\frac{1}{2}}$$

where L is the inductance per unit length and C is the capacitance per unit length. For situations where the three thicknesses of layers 12, 14 and 16 are all much smaller than the superconducting penetration depth, λ, the inductance is determined by the kinetic inductance, which is orders of magnitude greater than the magnetic inductance. It is under these conditions that phase velocities of 0.01 c are obtainable. A criterion for the "kinetic inductance" to be dominant is that:

$$\lambda_i \coth(t_i/\lambda_i) > d\ ,\ i=1 \text{ or } 2$$

where d is the thickness of the dielectric and $t_1$ and $t_2$ are the thicknesses of the thin film superconductors as shown in FIG. 1, and $\lambda_1$ and $\lambda_2$ are the corresponding penetration depths of the superconducting films 12 and 16. Since the effective wavelength, Λ, of the propagating wave in such a transmission line is given by:

$$\Lambda=v_p/f,$$

where f is the frequency, a half wavelength resonator at 3 GHz with $v_p=0.01$ c is only 0.5 mm long, whereas a half-wavelength resonator for an ordinary strip line with a dielectric of relative dielectric constant $\epsilon_r=2.3$ would be 3.3 cm. in length.

Similarly, to delay a microwave pulse by 100 ns would require an ordinary strip line with $\epsilon_r=2.3$ to have a length of 20 m, whereas the superconducting delay line with $v_p=0.01$ c would require length of only 30 cm. Since the width of the superconducting line is on the order of 20 μm as demonstrated in the above reference ("Measurements and Modeling of Kinetic Inductance Microstrip Delay Lines"), such a line could be fabricated very compactly in a spiral or meander pattern.

The attenuation of this line has been found to be dominated by dielectric losses and hence the loss is given by:

$$\alpha_d=(\pi f/v_p)(\epsilon''/\epsilon').$$

where $\epsilon''/\epsilon'$ is the dielectric loss tangent. With a dielectric loss tangent of $10^{-3}$, the loss of this line for 3 GHz signals would be 8.2 dB. The Q (which determines the frequency selectivity) of the 3 GHz superconducting resonator mentioned above is given by:

$$Q=\epsilon'/\epsilon''=1000.$$

It is seen that the attenuation of a delay line and the Q of a resonant structure of a compact superconducting structure of the type shown in FIG. 1 are limited by the dielectric material.

Clearly, the most desirable situation is to use a dielectric of vanishingly small loss tangent. Such an ideal dielectric is vacuum or gas (e.g. argon, nitrogen, etc.). Previously there has not been a method of fabricating the microstrip structures which had a small enough dielectric thickness (gap) between conductors, which dielectric thickness was also substantially uniform and low loss over a large enough area to produce a device of any practical use.

SUMMARY OF THE INVENTION

Accordingly, it is a general object of the invention to construct microwave microstrip transmission lines and circuits having a minimum amount of loss.

It is another object of the invention to construct microwave transmission lines and circuits having a pair of conductors separated by a vacuum dielectric or other gases having a uniform dielectric thickness between the opposing conductors.

These and other objects of the invention are accomplished by a method of fabricating a microstrip structure which includes etching a groove of the appropriate width and depth into the surface of a first substrate as determined by a preselected characteristic impedance. Appropriate thin film superconductors are then deposited on the surfaces of the first substrate and a second substrate. The thin film superconductors are then patterned after which the two substrates are sealed together by field-assisted thermal bonding such that a novel two-conductor electromagnetic transmission line results. Of course, a variety of circuits, including delay circuits, filter circuits and resonators can be fabricated with this process.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, wherein.

DESCRIPTION OF THE PREFERRED EMBODIMENT

Figure 1:
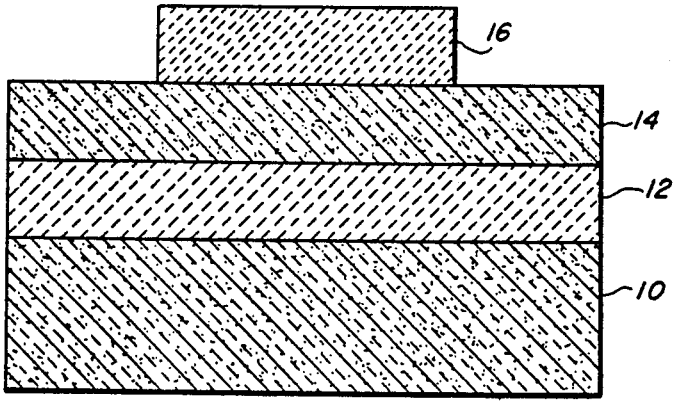
PRIOR ART FIG. 1
FIG. 1 is a cross-sectional view of the microstrip structure of the prior art.
Figure 2A:
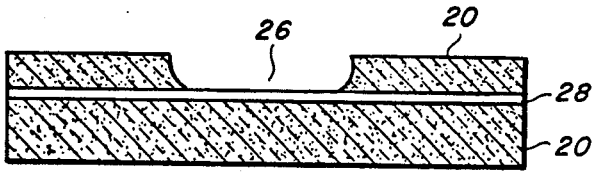
FIGS. 2*a* and 2*b* are cross-sectional views of first and second substrates of the preferred embodiment after etching of the first substrate to form a groove.
Figure 2B:
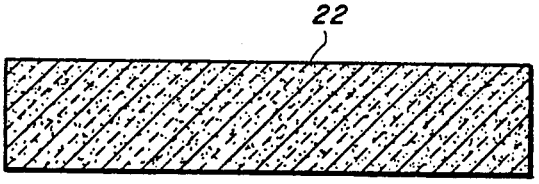

Accordingly, a method of fabricating a microstrip structure that carries out the requirements as described in the 'Background of the Invention' and shown in FIG. 1, but having substantially no dielectric loss, is disclosed. To fabricate such a microstrip structure with a uniform dielectric thickness (gap), the use of field assisted sealing of two substrates is proposed, to assure that the dielectric thickness (gap) remains constant over the length of the structure. To define the dielectric thickness (gap), grooves are etched into one of the substrates to a uniform depth equal to the desired gap thickness plus the thickness of the two superconducting films. A superconducting film of the appropriate thickness is then deposited in the grooves and patterned, followed by sealing of the two substrates.

The details of these steps are illustrated in FIGS. 2–6. FIGS. 2*a* and 2*b* show the first step in the processing. The surface of one or both substrates 20 and 22 has a groove 26 etched into it to a desired depth using standard photolithographic techniques to define the area where the groove is to be etched. The groove is etched, to a uniform depth, using standard chemical means which are appropriate to the substrate(s). Methods exist, using selective etches, which permit very uniform depths to be etched in many substrates, including Si and GaAs, for example. Another way to achieve a uniformly deep groove is through the use of an etch stop layer 28 employed in the substrate 20 of FIG. 2*a*, in which the groove 26 is to be etched, along with an appropriate selective etch. The creation of the etch stop layer 28 can be accomplished using any of several well known techniques including ion-implantation and epitaxial growth. For example, substrate 1 could consist of a layer of silicon epitaxially grown on sapphire. This heterostructure can be used, where the Si is of the desired thickness and can be selectively etched from the sapphire.

The width and depth of the etched groove 26 will be determined by the desired characteristic impedance of the resultant transmission line. In general, useful characteristic impedances can range from 1 ohm to 500 ohms. More commonly, characteristic impedances range from 10 ohm to 200 ohms. The most common characteristic impedance is 50 ohms. In general, groove depths can range from 20 nm to 200 μm. More commonly, groove depths can range from 50 nm to 10 μm. The most useful range for the groove depths is from 100 nm to 2 μm. Likewise, groove widths can range from 1 μm to 200 μm. More commonly, groove widths can range from 2 μm to 25 μm. The most useful range for the groove depths is from 5 μm to 10 μm.

Figure 3A:
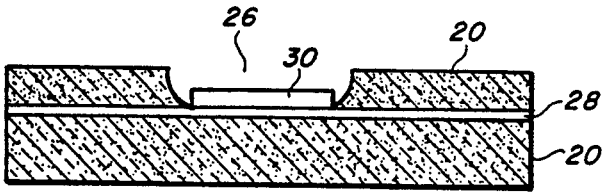
FIGS. 3*a* and 3*b* are cross-sectional views of the substrates of FIGS. 2*a* and 2*b* after deposition of thin film superconductors on each substrate and subsequent patterning.
Figure 3B:
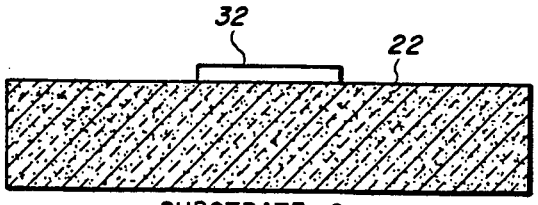

FIGS. 3*a* and 3*b* show the superconducting films 30 and 32 after being deposited on substrates 20 and 22 respectively, and patterned. The superconducting film 32 on the second substrate 22 can be patterned, by known standard photolithographic techniques as employed in other thin film processes, to correspond to the superconducting film 30 on the first substrate 20, as shown in FIG. 3*b*. The specifics of the patterning will be dependent on the substrate materials, the technique used to deposit the thin superconducting films, and the type of superconductors used. The superconducting thin films 30 and 32 can be deposited on the substrates using any appropriate thin film deposition technique such as sputtering or evaporation. In general, the superconducting films 30 and 32 can range in thickness form 5 nm to 5 μm. More commonly, the superconducting film thicknesses can range from 10 nm to 500 nm. The most useful range for superconductor thickness ranges from 20 nm to 100 nm. The widths of the superconducting films 30 and 32, after patterning, are constrained by the fact that the width of the of the films must be less than the width of the groove 26. The geometry of the groove 26, the thickness of the superconductors 30 and 32, and their properties all determine the characteristic impedance of the resultant microstrip transmission line as shown in FIG. 6.

Figure 6:
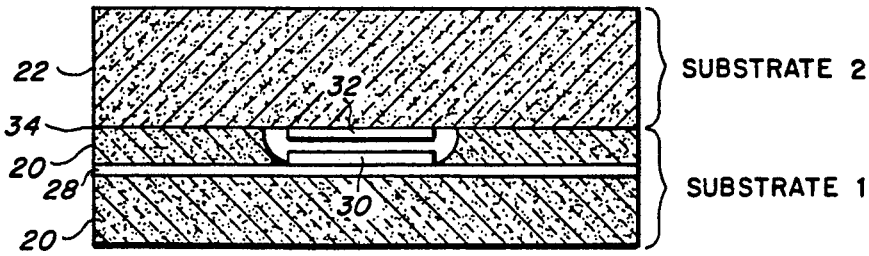
FIG. 6 is a cross-sectional view of the substrates of FIGS. 3*a* and 3*b* after the two substrates have been bonded together to form the resultant microstrip structure as shown.

FIG. 6 shows the alignment of the substrates 20 and 22 just before and after the substrates are sealed using a field-assisted thermal bonding process. The two substrates 20 and 22 are aligned and then mechanically clamped together. The dielectric thickness (gap) that is used in place of the layer of dielectric material of FIG. 1 (prior art), to separate the two conductors is obtained by this cover plate arrangement. Thus the first substrate 20 is joined to the second substrate 22 by this method of field assisted sealing, to give a uniform bonding with very narrow spacing between the two superconducting films 30 and 32 (on the order of several hundred to several thousand Angstroms). NbN and Nb have been shown to be compatible superconductor materials with substrates of glass and silicon. In this method of sealing, integral and uniform contact is achieved by application of an electric potential across the interface 34 of the first and second substrates 20 and 22 while the substrates are maintained at an elevated temperature, but well below their softening points. The strength of the electric field needed and the temperature applied are dependent on the substrates 20 and 22 and superconductors 30 and 32 used. In general, a trade-off exists between the electric field strength and the temperature employed. For an example of this technique see "Field Assisted Glass-Metal Sealing", *J. Appl. Phys.*, Vol. 40, no. 10, pp. 3946–3949, September 1969 by G. Wallis and D. I. Pomerantz. There are several constraints that exist on the materials to be used in order for this method of field-assisted sealing to work properly. For instance the substrates used must be compatible with the field-assisted bonding technique so that a tight bond exists between the substrates, resulting in uniform separation of the patterned superconducting thin films. In addition, the substrate materials must be compatible with the deposition of thin film superconductors which have sufficiently good microwave loss properties that the resultant transmission line has acceptable attenuation properties.

Figure 4A:
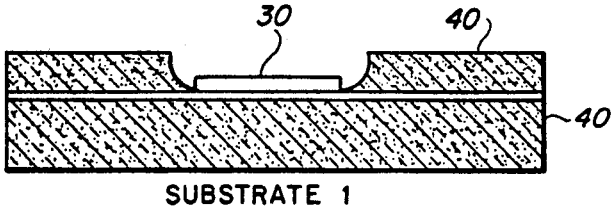
FIGS. 4*a* and 4*b* are cross-sectional views of the substrates of FIGS. 2*a* and 2*b* after deposition of thin film superconductors on each substrate and a first alternate method of patterning the thin films to give the structure shown.
Figure 4B:
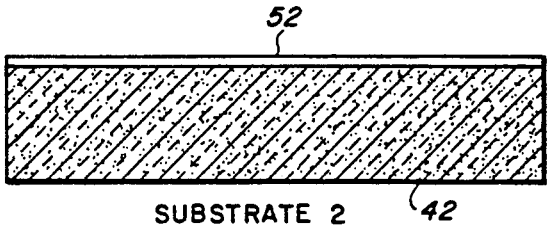

FIGS. 4*a* and 4*b* show an alternate structure of substrates 1 and 2. As shown in FIG. 4*b*, if a field-assisted thermal bond can be obtained between the top surface of the first substrate 40 and the superconducting film 52 of the second substrate 42, this film 52 need not be patterned prior to field-assisted thermal sealing as was described in regard to FIG. 6.

Figure 5A:
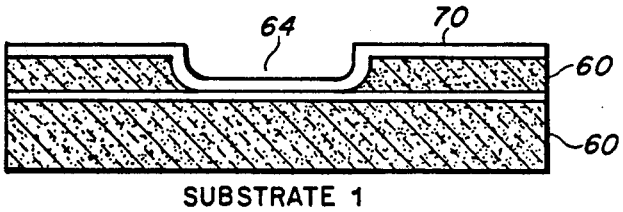
FIGS. 5*a* and 5*b* are cross-sectional views of the substrates of FIGS. 2*a* and 2*b* after deposition of thin film superconductors on each substrate and a second alternate method of patterning the thin films to give the structure shown.
Figure 5B:
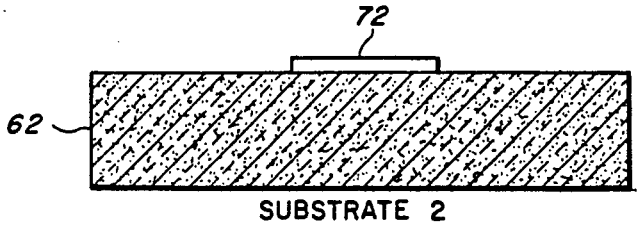

FIGS. 5*a* and 5*b* show a variation of the structure of FIGS. 4*a* and 4*b* where the thin film superconductor 70 on the first substrate 60 does not need to be patterned. Here however the superconducting film 72 on the second substrate 62 will need to be patterned in order to be aligned to the groove 64. In this case, the superconductor material 70, deposited on the first substrate 60 must have appropriate properties such that the field-assisted thermal bonding technique will seal the superconducting film 70 deposited on the first substrate 60 to the second substrate 62.

The foregoing has described a method of fabricating a microstrip structure which consists of etching grooves of the appropriate width and depth into the surface of a substrate as determined by a preselected characteristic impedance, depositing appropriate thin film superconductors on the surfaces of two substrates, patterning the thin film superconductors, and sealing the two substrates together by field-assisted thermal bonding such that a novel two-conductor electromagnetic transmission line results. Various circuits, including delay circuits, filter circuits and resonators can be fabricated with this process.

Obviously, numerous modifications and variations of the present invention are possible in light of the above teachings. It is therefore to be understood that within the scope of the appended claims, the invention may be practiced otherwise than as specifically described herein.

We claim:

1. An ultra-low-loss microstrip structure comprising:

a first substrate having a groove in a first surface, wherein said groove has a depth and a width;

a first, thin film conductor on a bottom surface of said groove;

a second substrate having a second surface disposed opposite from said first surface;

a bond between said first surface and said second surface; and a second, thin film conductor on said second surface, wherein said second conductor is patterned such as to lie opposite said first thin film conductor; wherein, said first and second thin film conductors each having a thickness, a width, and material properties; and wherein, the depth of said groove, and the width, thickness, and material properties of said first and second thin film conductors cooperate to give the resulting micro strip a preselected characteristic impedance.

2. The microstrip structure of claim 1, wherein said first and second thin film conductors are made of superconducting materials.

3. The microstrip structure of claim 2, wherein said first and second thin film conductors are made of superconducting materials selected from the group consisting of niobium and niobium nitride.

4. The microstrip structure of claim 2, wherein said first substrate is made of silicon and said second substrate is made of glass.

5. The microstrip structure of claim 2 wherein said bond is a field assisted thermal bond.

6. An ultra-low-loss microstrip structure comprising:

a first substrate having a groove in a first surface, wherein said groove has a depth and a width;

a first, thin film conductor on a bottom surface of said groove;

a second substrate disposed opposite from said first surface;

a second, thin film conductor on a second surface of said second substrate, said first and second thin film conductors each having a thickness, a width, and material properties; and a bond among said first surface, said second thin film conductor, and said second surface;

wherein, the depth of said groove, and the width, thickness, and material properties of said first and second thin film conductors cooperate to give the resulting micro strip a preselected characteristic impedance.

7. The microstrip structure of claim 6, wherein said first and second thin film conductors are made of superconducting materials selected from the group consisting of niobium and niobium nitride.

8. The microstrip structure of claim 6, wherein said first and second thin film conductors are made of superconducting materials.

9. The microstrip structure of claim 8, wherein said first substrate is made of silicon and said second substrate is made of glass.

10. The microstrip structure of claim 8 wherein said bond is a field assisted thermal bond.

11. An ultra-low-loss microstrip structure comprising:

a first substrate, said first substrate having a groove disposed in a first surface of said first substrate, wherein said groove has a depth, said first substrate includes a first thin film conductor material deposited on said first surface including said groove;

a second substrate, opposite said first substrate, said second substrate includes a second thin film conductor material deposited on a first surface of said second substrate and wherein said first and second thin film conductors each have a width, a thickness, and material properties;

said first thin film material on said first substrate is in contact with said first surface of said second substrate, said first and second thin film materials are separated by a gap having a uniform width defined by said groove, wherein the gap acts as a dielectric between the two thin film materials;

a bond between said first surface and said second surface; and wherein, the depth of said groove, the width, and thickness, and materials properties of said first and second thin film conductors cooperate to give the resulting micro strip a preselected characteristic impedance.

12. The microstrip structure of claim 11 wherein said first and second thin film conductors are made of superconducting materials.

13. The microstrip structure of claim 12, wherein said first and second thin film conductors are made of superconducting materials selected from the group consisting of niobium and niobium nitride.

14. The microstrip structure of claim 13, wherein said first substrate is made of silicon and said second substrate is made of glass.

* * * * *